United States Patent [19]

McKinney et al.

[11] 4,035,594

[45] July 12, 1977

[54] SLIDE SWITCH

[75] Inventors: Richard W. McKinney, Lakewood; Allen L. Teichert, Placentia, both of Calif.

[73] Assignee: Robertshaw Controls Company, Richmond, Va.

[21] Appl. No.: 655,089

[22] Filed: Feb. 4, 1976

[51] Int. Cl.[2] ..... H01H 15/06

[52] U.S. Cl. ..... 200/16 D

[58] Field of Search ..... 200/16 C, 16 D, 76, 200/77, 291

[56] References Cited

U.S. PATENT DOCUMENTS

| | | | |
|---|---|---|---|
| 2,880,284 | 3/1959 | Laete | 200/16 C |
| 3,072,757 | 1/1963 | Gluck | 200/16 D |
| 3,271,535 | 9/1966 | Vananzi | 200/16 C |
| 3,299,226 | 1/1967 | Edwards | 200/16 C |
| 3,311,719 | 3/1967 | Vananzi | 200/16 C |
| 3,316,364 | 4/1967 | Schink | 200/16 C |
| 3,319,016 | 5/1967 | Hoy et al. | 200/16 C |
| 3,461,252 | 8/1969 | Vananzi | 200/16 C |

FOREIGN PATENT DOCUMENTS

| | | | |
|---|---|---|---|
| 925,257 | 5/1963 | United Kingdom | 200/16 D |

*Primary Examiner*—James R. Scott

*Attorney, Agent, or Firm*—Fulwider, Patton, Rieber, Lee & Utecht

[57] ABSTRACT

A slide switch is formed by a housing which slidably receives a carrier with a resilient spring contact which bridges between selected pairs of a plurality of contact poles disposed in a longitudinal row along one wall of the housing. The spring contact member is received within the carrier and is biased therein against a fulcrum abutment to provide a resilient rocking action in making and breaking electrical contact. The spring contact member also resiliently biases the detent of the switch which includes a plurality of transverse slots disposed along an opposite wall of the housing with cooperative rib members on the engaging surface of the carrier.

4 Claims, 8 Drawing Figures

SLIDE SWITCH

BACKGROUND OF THE INVENTION

1. Field of Invention

This invention relates to electrical switch means and, in particular, to an electrical slide switch of improved construction and simplicity.

2. Brief Statement of the Prior Art

Electrical slide switches as typically constructed employ a housing which receives a carrier for the spring contact member. The housing has an elongated slot through which projects a lever. The carrier has a cavity which receives the spring contact member such that when the carrier is moved between distal positions in the housing slot, the spring contact member makes and breaks electrical contact between selected pairs of contact poles disposed along the bottom surface of the housing.

The slide switch commonly employs an assembly of two or more leaf spring members as the spring contact member such as shown in U.S. Pat. No. 3,461,252. Attempts have been made to obtain a snap action in the making and breaking of electrical contacts. One attempt, shown in U.S. Pat. No. 3,072,757, employs a single element spring contact member which is bowed outwardly at a central portion to provide a central protrusion that rides over the contact poles and thereby effects a rocking action to the spring contact member. Another attempt to obtain a snap action is shown in U.S. Pat. No. 3,674,953, which employs a complex spring link between the switch lever and the contact carrier.

The aforementioned slide switches generally lack positive action detent mechanisms and, instead, generally rely upon a detenting action between the spring contact member and the contact poles to restrain the carrier in its selected position. Additionally, the slide switches are usually provided with only two carrier positions which are at the distal positions of the lever in the slot of the housing whereby the housing slot serves as a stop for the carrier when the carrier reaches its selected position.

BRIEF STATEMENT OF THE INVENTION

This invention comprises a slide switch having positive acting detent means for the carrier and having a minimal number of parts, thereby providing a minimum of assembly effort and insuring a long operational life.

The slide switch of the invention comprises a generally elongate housing bearing a longitudinal slot in one wall thereof and a carrier slidably received in the housing with lever means projecting from the carrier through the slot of the housing. The carrier has a receptacle means that is orthogonal to the lever means for receiving a spring contact member. The spring contact member is a single element leaf spring having distal reverse bends to provide distal legs which terminate centrally of the carrier and bear against an abutment of the carrier whereby the spring contact member has a fulcrum support in the carrier. The spring contact member has a central protrusion on its contact surface which is defined by an outward bow in the spring element.

The housing bears a longitudinal row of contact poles disposed along one wall for exposure to and sliding contact with the spring contact member. The opposite wall of the housing bears a plurality of transverse slots which function, with transverse ribs on the mating surface of the carrier, as positive acting detent means. The spring contact member resiliently biases the carrier against the transversely slotted wall of the housing to impart positive seating of the transverse ribs of the carrier in the transverse slots of the housing at selected contact positions of the carrier.

The central protrusion of the spring contact member rides over the contact poles and effects a resilient rocking action to the making and breaking of electrical contact by the distal portions of the spring contact member while providing adequate resilient bias to the carrier to insure a positive action of the carrier detent means.

BRIEF DESCRIPTION OF THE DRAWINGS

The invention will be described with reference to the figures of which.

DESCRIPTION OF PREFERRED EMBODIMENTS

Figure 1:
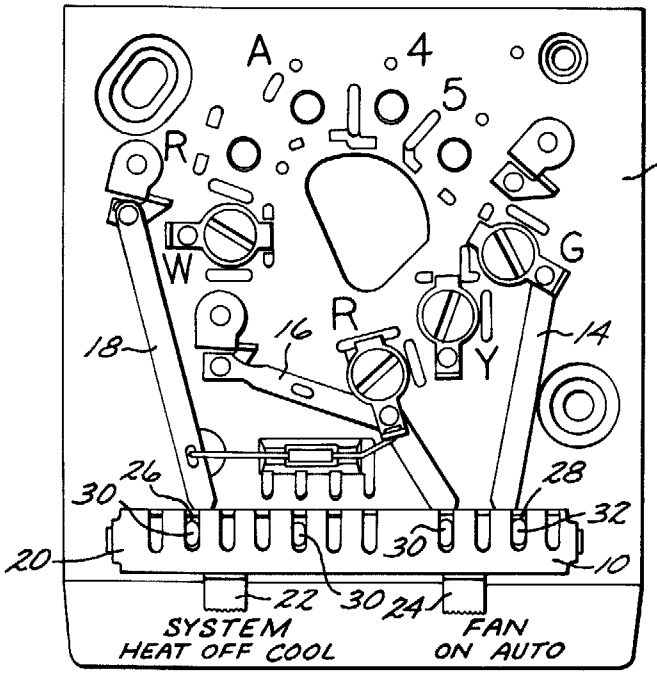
FIG. 1 illustrates a thermostatic control circuit employing the slide switch of the invention.

FIG. 1 illustrates the switch 10 of the invention incorporated in a thermostatic control device formed with a base plate 12 on which are disposed a plurality of conductors such as bus bars 14, 16 and 18. Switch 10 is illustrated as a single housing 20 which has two carriers with respective levers 22 and 24. The carrier for lever 22 is movable between three selectable positions generally indicated with the legends HEAT, OFF, and COOL on the base plate 12 while the carrier for lever 24 is movable between two selectable positions indicated as ON and AUTO on base 12.

The switch means of the invention are provided with positive acting detent means which appear as a plurality of transverse slots 26 and 28 for each of the switch means. The transverse slots 26 cooperate with rib means 30 and 32 carried on the opposed surface of the carrier and these rib means are positioned on the carrier to seat in a respective slot 26 when the carrier is moved to one of its selectable positions.

Figure 2:
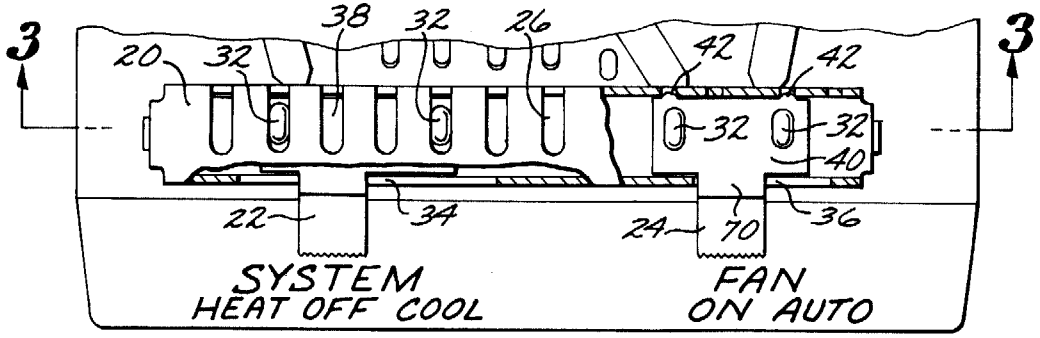
FIG. 2 is a view of the switch housing and carrier of the invention.

Referring now to FIG. 2, the housing is shown in partial sectional view to expose the carriers and slot means of the housing. As shown in FIG. 2, the housing has two longitudinal slots 34 and 36 along one wall thereof. Slidably carried in housing 20 are carriers 38 and 40 which bear, respectively, lever means 22 and 24 which project to one side thereof and extend through slots 34 and 36. Each carrier bears a pair of distal buttons such as 42 shown with carrier 40 which provide sliding contact with the interior wall of the housing and minimize frictional resistance to movement of the carrier. As previously mentioned, each carrier also bears a pair of transverse ribs 30 and 32 which cooperate with the slots such as 26 and 28 of the housing to serve as detent means.

Figure 3:
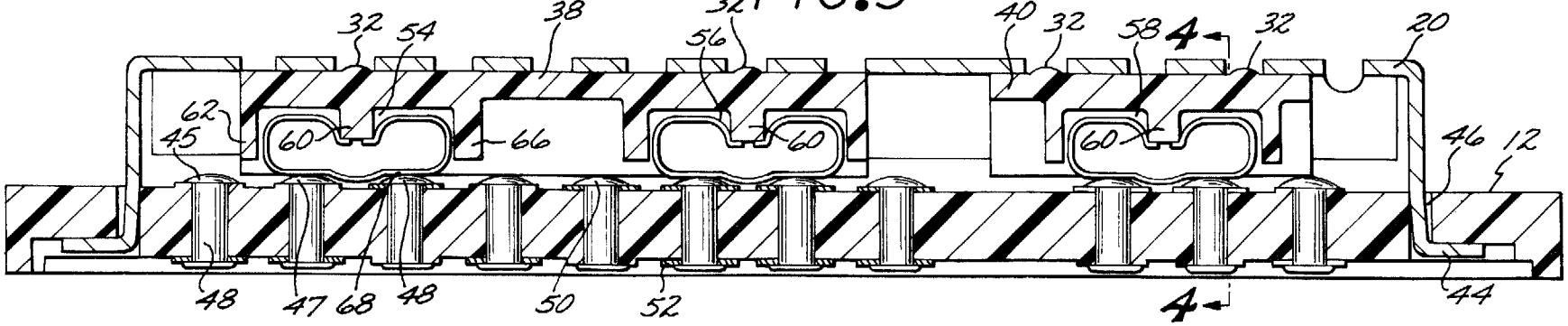
FIG. 3 is an elevation sectional view through the switch members of the invention.

Referring now to FIG. 3, the construcional details of the switch mechanism will be more apparent. As shown in FIG. 3, housing 20 rests on base 12 and is secured thereto by tabs 44 which extend through slots 46 distally located on base 12. The tabs 44 are bent, as illustrated, to provide an interlock of housing 20 to base 12. Base 12 thereby serves as a bottom closure of housing 20.

A plurality of contact poles 48 are provided in a longitudinal row in housing 20. The poles are formed by rivets and the like having a round head 50 along the upper surface of base 12 and extending through base 12 and into contact with various conductors such as 52 on the reverse side of base 12.

The carriers 38 and 40 are provided with receptacle means in the form of cavities 54 and 56 of carrier 38 and cavity 58 of carrier 40. Each cavity bears a central abutment 60 and has distal transverse walls such as 62 and 66, which define the confines of the cavity.

Received within each of cavities 54, 56 and 58 are spring contact members 68 which are single element leaf spring members which are described in greater detail hereinafter with regard to FIGS. 5–8. The spring contact members function to provide bridging contact between selected pairs of adjacent contact poles and to provide a resilient bias for achieving a positive detenting action of ribs 30 and 32 carried on the upper surface of carriers 38 and 40 in the transverse slots 26 and 28 of the top wall of the housing 20.

Figure 4:
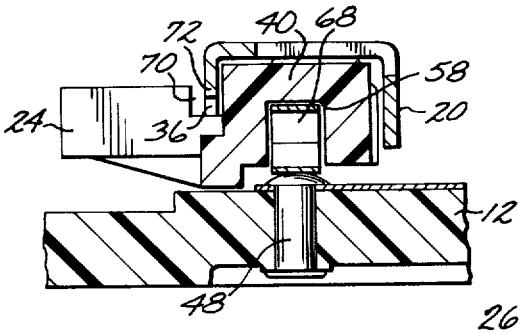
FIG. 4 is an elevational sectional view transverse to the housing of the switch members.

Referring now to FIG. 4, there is illustrated a sectional elevation view through the switch assembly. As there illustrated, base 12 supports housing 20 with the row of contact poles 48 disposed directly beneath the receptacle means, i.e., cavity 58. The resilient spring contact member 68 is received within cavity 58 and bears against the upper ends of contact poles 48. The carrier has lever means 24 projecting from one side thereof through the elongated slot 36 of the housing 20. Preferably the upper surface of lever 24 bears a groove 70 which receives the upper edge 72 of slot 36, interlocking the carrier 40 to the housing 20.

Figure 5:
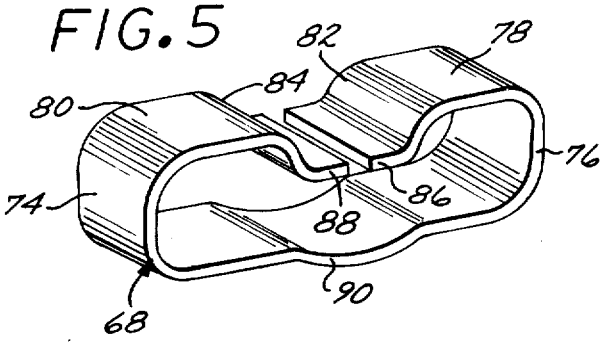
FIG. 5 is a prospective view of the spring contact member of the invention.
Figure 6:
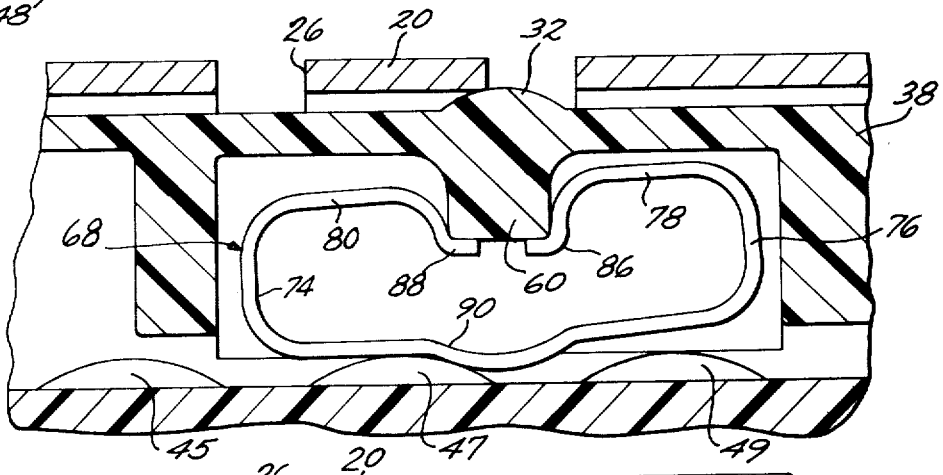
FIGS. 6–8 illustrate the snap action of the spring contact member and the detenting of the carrier in the housing. Also shown is the rocking action.

Referring now to FIG. 5, the spring contact member 68 is shown as a single element leaf spring bearing distal reverse bends 74 and 76 which provide resilient legs 78 and 80. The ends of legs 78 and 80 are provided with S-bends 82 and 84 to provide inset lips 86 and 88 for engagement against abutment 60 in the manner illustrated in FIG. 3. The central undersurface of spring contact member 68, bears a central protrusion in the form of an outward bow 90, to facilitate the rocking action of the switch in the manner described with regard to FIGS. 6 and 7. Referring now to FIG. 6, there is illustrated the initial movement of the spring contact 68, from contact with poles 47 and 49. The initial movement of the carrier 38 to the left results in a downward movement of the carrier to permit rib 32 to pass beneath the top wall of housing 20. Coincident with this movement, and resultant compression of the spring contact member 68, is the contact of the central, outward bow 90 of the spring contact member with the rounded head of contact pole 47. This results in an upward thrust of the right leg 78 of spring contact member 68 which responds in a rocking movement away from contact pole 49.

Figure 7:
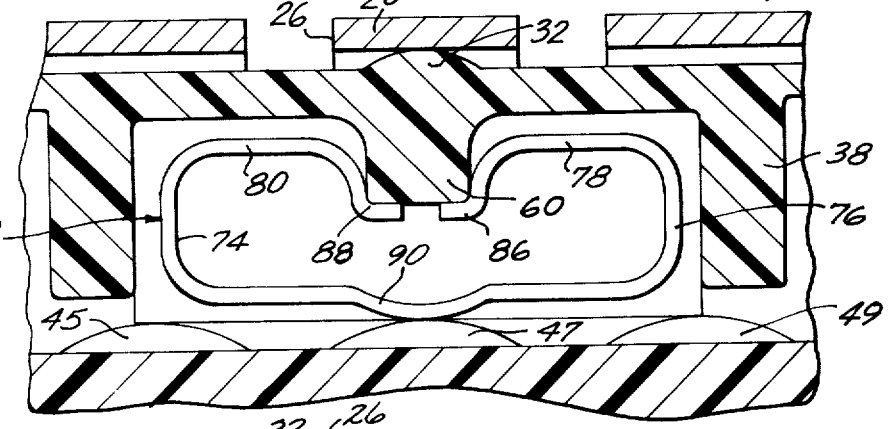
Figure 8:
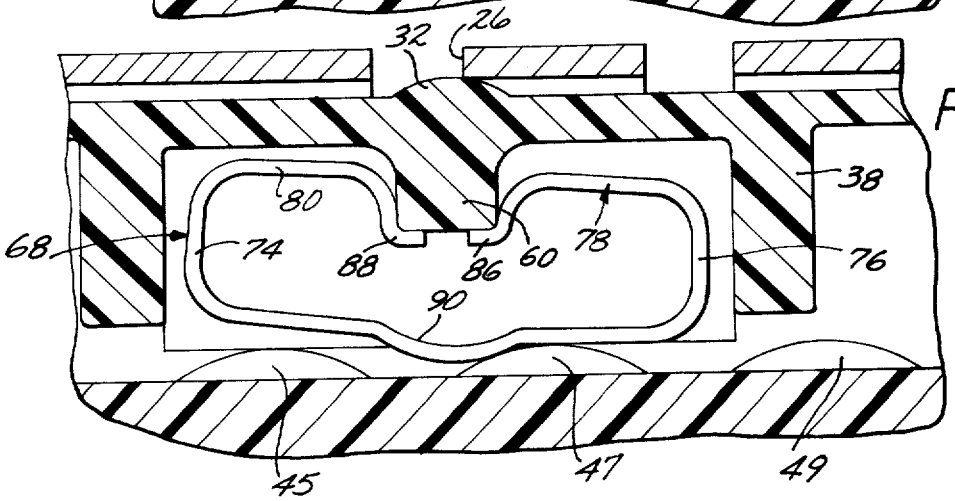

The continued movement of carrier 38 in a leftward direction causes the outward central bow 90 to ride over the contact pole 47 and compress spring legs 78 and 80 in an equal amount, in the manner illustrated in FIG. 7. The continued movement past the center position shown in FIG. 7 results in an upward thrust on spring leg 80 as the center bow 90 moves downwardly on the rounded surface of contact pole 47, raising contact leg 80 in the manner illustrated in FIG. 8. This leg of the contact member is thereby separated from direct contact with contact pole 45 until the leg 80 is directly above this contact pole. At this point, continued movement will cause the outward bow 90 to reach its maximum position between contact poles 45 and 47, lowering the leg 80 into contact with contact pole 45. Coincident with this positioning of the spring contact member 68 is the movement of rib 32 into a positive detenting position within the the transverse slot 26.

The switch mechanism as thus described employs a minimum number of parts, requiring only a housing, carrier, spring contact member and a plurality of contact poles. A positive detent action of the carrier with the housing provides a positive seating of the carrier in a preselected one of a plurality of positions, thereby permitting the carrier to be moved into any of a plurality of positions intermediate of its travel along the housing.

The switch mechanism is also simple in manufacture, requiring a minimal number of parts for assembly and is readily adaptable to automated or semi-automated assembly, e.g., the contact poles can be readily inserted and secured to electrical condutors by an automated riveted procedure.

The invention has been described with reference to the presently preferred and illustrated embodiment thereof. It is not intended that the invention be unduly limited by the illustrated embodiment. Instead, it is intended that the invention be defined by the means, and their obvious equivalents, set forth in the following claims.

What is claimed is:

1. A slide switch assembly comprising:

an elongate housing of a base plate and a surmounted channel member defining a track with elongated slot means in one wall thereof;

a plurality of arcuate-surface, contact poles disposed within said housing in a longitudinal row along said base plate;

a contact carrier slidably received in said track, bearing lever means projecting through said slot means and having a longitudinal receptacle cavity facing said contact poles and an abutment rib transversing said cavity and of lesser height than the cavity walls;

detent means comprising a plurality of transverse slots along the wall of said housing opposite said row of contact poles and cooperative external rib means on the opposing surface of said carrier; and a leaf spring contact member having a central, outward bow on its undersurface to provide an arcuate protrusion thereon, distal reverse bends, superior return legs and terminal bends to provide central, superior inset lips; said contact member seated in said receptable cavity of said carrier with said central inset lips bearing against said abutment rib in fulcrumed support thereon and biasing said external rib means towards said transverse slots of said detent means, with the arcuate protrusion of said member seated between selected pairs of said contact poles and the undersurface of said contact member bridging between said pairs of contact poles.

2. The slide switch assembly of Claim 1 wherein said contact poles are arcuate heads of rivet members extending through said base plate and secured in said base plate to attach conductor members thereto.

3. The slide switch assembly of claim 1 wherein said carrier bears a plurality of receptacle means, each receiving separate spring contact members.

4. The slide switch assembly of claim 1 wherein said lever means bears a transverse groove to receive the edge of said slot means.

* * * * *